US011006721B2

(12) United States Patent
Christie

(10) Patent No.: US 11,006,721 B2
(45) Date of Patent: May 18, 2021

(54) NOVELTY NAIL CUTTING OR TRIMMING TOOL

(71) Applicant: Christie & Christie Pty Ltd., Brisbane (AU)

(72) Inventor: Julia Christie, Banora Point (AU)

(73) Assignee: Christie & Christie Pty Ltd, Brisbane (AU)

( * ) Notice: Subject to any disclaimer, the term of this patent is extended or adjusted under 35 U.S.C. 154(b) by 0 days.

(21) Appl. No.: 15/764,024

(22) PCT Filed: Dec. 15, 2017

(86) PCT No.: PCT/AU2017/000281

§ 371 (c)(1),
(2) Date: Mar. 28, 2018

(87) PCT Pub. No.: WO2018/107207

PCT Pub. Date: Jun. 21, 2018

(65) Prior Publication Data

US 2019/0289977 A1 Sep. 26, 2019

(30) Foreign Application Priority Data

Dec. 16, 2016 (AU) ..... 2016102128

(51) Int. Cl.
*A45D 29/02* (2006.01)
*A45D 29/04* (2006.01)
(Continued)

(52) U.S. Cl.
CPC ..... *A45D 29/02* (2013.01); *A45D 29/04* (2013.01); *A45D 29/16* (2013.01); *A45D 29/17* (2013.01);
(Continued)

(58) Field of Classification Search
CPC ..... A45D 29/02; A45D 29/04; A45D 29/17; A45D 29/18; B25G 29/17; B25G 1/102;
(Continued)

(56) References Cited

U.S. PATENT DOCUMENTS 219,633 A 9/1879 Gifford
464,341 A 12/1891 Lewis
(Continued)

FOREIGN PATENT DOCUMENTS

EP 02022139 11/1986
KR 200480087 4/2016
WO WO-2018107207 A1 * 6/2018 ..... A45D 29/02

OTHER PUBLICATIONS

Novelty nail clippers [retrieved from the internet on Mar. 28, 2017] <https://web.archive.org/web/20160406184351/http://vistatrg.com/new142.htm> archived on archive.org Apr. 6, 2016; dated Nov. 21, 2012.

(Continued)

*Primary Examiner* — Omar Flores Sanchez
(74) *Attorney, Agent, or Firm* — Bonini IP Law, LLC; Frank J. Bonini, Jr.

(57) ABSTRACT

A novelty nail trimming tool 10 includes a metal chassis 11 comprising a base 12 a neck section 13 and a head section 14. The head section 14 includes a pair of guards 15 and 16 which are also configured as the eyes or feelers of a snail. The base 12 has a knurled or roughened surface 17 forming a nail file. The head 14 has a v-blade 18, while the neck 13 is set at an angle of about 30 degrees to the base. A handle 19 in the form of a snail shell 20 is attached to the base 12 by a hand insertable clip action into three slots 21, 22 and 23 by reason of upturns 24, 25 and 26 in the base 12.

21 Claims, 2 Drawing Sheets

(51) Int. Cl.

| | |
|---|---|
| ***A45D 29/17*** | (2006.01) |
| ***B25G 1/10*** | (2006.01) |
| ***B26B 27/00*** | (2006.01) |
| ***B26B 29/00*** | (2006.01) |
| ***A45D 29/16*** | (2006.01) |
| ***A45D 29/18*** | (2006.01) |
| ***B26B 13/18*** | (2006.01) |

(52) U.S. Cl.
CPC ..... *A45D 29/18* (2013.01); *B25G 1/102* (2013.01); *B26B 13/18* (2013.01); *B26B 27/00* (2013.01); *B26B 29/00* (2013.01)

(58) Field of Classification Search
CPC ..... B26B 27/00; B26B 29/00; B26D 29/00; B26D 13/18
See application file for complete search history.

(56) References Cited

U.S. PATENT DOCUMENTS

| | | | | |
|---|---|---|---|---|
| 1,255,043 | A | 1/1918 | Pease | |
| 1,566,712 | A | 12/1925 | Wendt | |
| 1,855,063 | A | 4/1932 | Lovette | |
| D445,959 | S * | 7/2001 | Ricci | D2/643 |
| 7,322,107 | B2 * | 1/2008 | Lam | A45D 29/16 132/75.3 |

OTHER PUBLICATIONS

Novelty nail clippers [retrieved from the interent on Mar. 28, 2017] <http://web.archive.org/web/20150201042308/http://www.amazon.com/Cartoon-Clippers-Trimmer-Scissors-Creative/dp/B00M45ROYO?> archived on archive.org Feb. 1, 2015.

* cited by examiner

NOVELTY NAIL CUTTING OR TRIMMING TOOL

TECHNICAL FIELD OF THE INVENTION

This invention relates to nail trimmers and in particular but not limited to nail trimmers for babies and infants.

BACKGROUND TO THE INVENTION

Hand tools are known which can be used for cutting or trimming nails. These are unusually known as nail clippers or trimmers and are known in a variety of forms. One form uses a scissor action with scissor blades. The blades may be curved. Another form uses a press lever where sprung jaws slide relative to each other on a guide and the lever is used to close the jaws over a nail to be trimmed. Each jaw has a curved blade. In another version a v-blade is used and is slid along a nail to trim an edge of the nail. These all may be made in different sizes with smaller sizes being for smaller nails. Each of these has their different advantages.

Trimming small babies fingernails and toenails can be a very daunting and difficult task. Traditionally nail clippers, or baby scissors have been used for the difficult task of cutting nails. It is very hard to see what is actually being cut, they are very slippery and difficult to hold and maneuver and it can often result in injury to the child's fingers.

It would be desirable to provide a hand tool for trimming infant nails that takes some of the stress and anxiety out of this process for both parent and infant.

OUTLINE OF THE INVENTION

In one aspect therefore the present invention resides in a novelty nail cutting or trimming tool employing at one end a cutting blade arrangement employing as an essential feature fixed blades and at the other end a handle arrangement, the tool having a novelty aspect to amuse and comfort a child or infant, the novelty aspect being so made and arranged that it aids in the functional operation of cutting nails. In a preferred form there is provided a nail cutting or trimming tool being a toy like nail care tool having a trimming blade at the one end with a safety guard adjacent the trimming blade.

Preferably, the one end that comprises a cutting blade arrangement is configured as a novelty part to amuse and comfort and the other end comprising the handle arrangement comprises a second novelty part to amuse and comfort, each of the novelty parts being recognisable as anatomically significant, the configuration dimensions and relative disposition of the handle arrangement and the cutting blade arrangement being so made and arranged that they aid in the operation of cutting nails. In terms of being anatomically significant it is preferable the one end having the cutting blade arrangement correspond to a "head" end and the other end comprising the handle arrangement comprises a "rear" end so that the tool has anatomically significant and recognisable head and rear. For example, the rear may include a tail. The tail may be shaped as an under nail cleaner thus performing a dual function. Where a cutting guard is employed these may be formed as eyes thus performing a dual function. There may be what is perceived as a "neck" between what is perceived as a "torso" or main body and the neck may functionally aid in manipulation of the tool, thus providing a dual function. Thus the "tail", "head", "neck" and "body" preferably act in combination to function as a nail cutting or trimming tool.

In the present specification the word "novelty" is intended to mean toy, plaything or amusement and the relationship between the cutting blades and the handle and the novelty aspect gives rise to functional operation of the tool. In one example cutting blades have adjacent protruding eyes which also serve as a protective guard for adjacent fingers and toes. In another example the handle is configured as a snail shell but the shell is sized to aid manipulation of the tool. In another example the shell has a front projection that aids digital manipulation. In another aspect the tool has a under nail cleaning projection adjacent to the handle and being manipulable by the handle.

Preferably, the cutting blade arrangement is configured as a creature head or part of a head and the handle arrangement is configured as a creature body. These can be real or abstract but as long as they achieve the goal of amusing and comforting, as a precursor to the task of cutting or trimming nails, then, subject of course to the adult's attitude, the exercise of nail trimming can be fun. The cutting blade arrangement may include a pair of blades. These may be fixed blades in a v-configuration.

Preferably, in functional terms the handle includes a narrow part proximal the blades and a relatively wide part remote from the blades.

Preferably, the tool comprises a handle mounted to a chassis, the chassis having a longitudinal axis with a base and a neck terminating at a cutting head, there being a juncture between the base and the neck such that neck extends from and is inclined to the base, the handle at an end opposite to the head having a narrow aspect substantially across a central longitudinal plane of the tool and a wide aspect substantially along the central longitudinal plane of the tool, the handle tapering in the region of the juncture between the base and the neck. Preferably, the tool does not have any moving parts and the tool has a nail file and a nail cleaning projection, both adjacent to the handle arrangement.

The present invention provides a much easier, safer and faster way to trim nails. In one preferred embodiment it is a three in one (3-in-1) nail care tool. Typically, functionally, it has a trimming blade with a safety guard, a nail file and an under nail cleaner. In this embodiment it provides a complete and compact nail care system. While it has a novelty feature embodied in its functional operation it is a personal hygiene and care tool, to be used by adults and is not a toy thus the use of the expression "toy-like."

Preferably, it has no moving parts and makes not harsh sounds. It is long lasting and durable, and in a further preferred form has as its novelty aspect a snail having the following features:

- The trimming blade or the 'head' of the snail is a v-shaped metal blade with folded up 'eyes' that act as a safety guard so to protect the other fingers/toes. The blade makes it very easy to see the exact width of nail being trimmed and can easily follow the natural curve of the nail bed.
- The 'neck' can carry product name and there is space also on the underside for branding.
- The 'shell' is rounded and has a flatter part near the neck and is taller at the back. This ergonomic design allows maneuverability, safe grip and handling. It is covered with rubber and the rubber makes it easy to grip. It fits well in the hand of the adult.
- The nail file is on the underside or base and may be used to assist in trimming rough or sharp nail edges.

The under nail cleaner may be at a rear end and can be used to remove dirt and grime from underneath fingernails and toenails and also lift out ingrown nails to then cut them.

It is not a choking hazard due to the length of tool which in a preferred case is about 60 mm long.

It can be made to be dishwasher safe and be shaped and dimensioned to be cleaned on the top shelf of a dishwasher or in warm soapy water.

BRIEF DESCRIPTION OF THE DRAWINGS

In order that the present invention may be more readily understood and be put into practical effect reference will now be made to the accompanying drawings which illustrate one preferred embodiment of the invention and wherein.

PREFERRED EMBODIMENT

Figure 1:
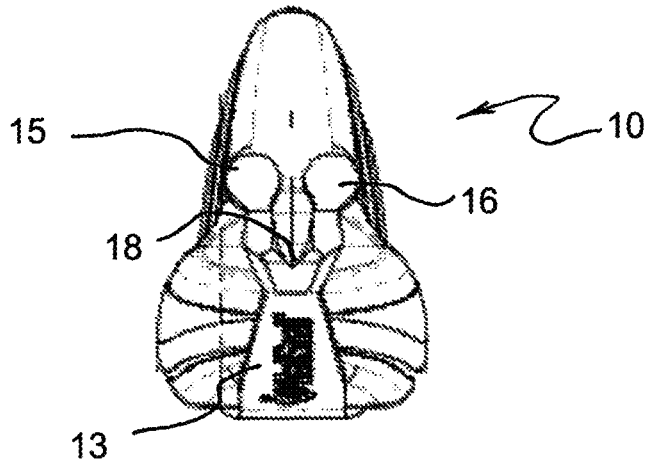
FIG. 1 is a front view.
Figure 2:
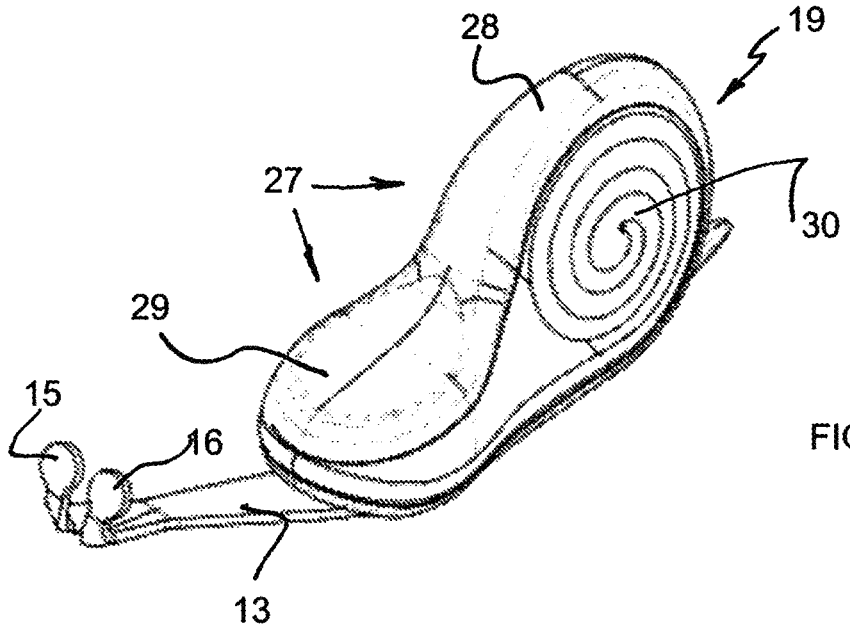
FIG. 2 is a front perspective view from above and to the left side.
Figure 3:
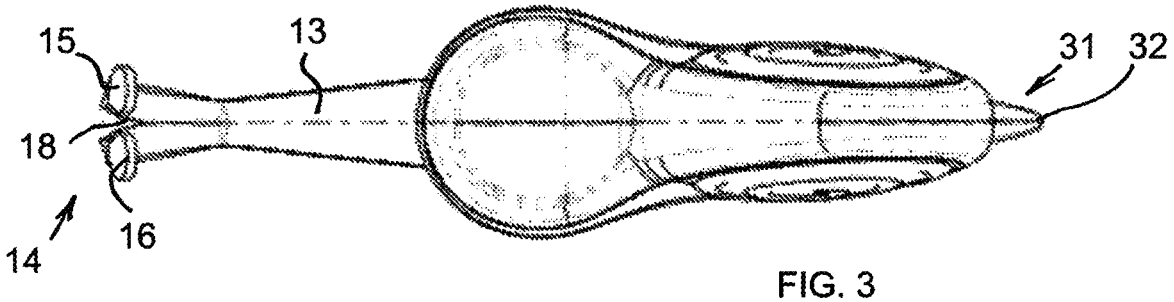
FIG. 3 is a top view.
Figure 4:
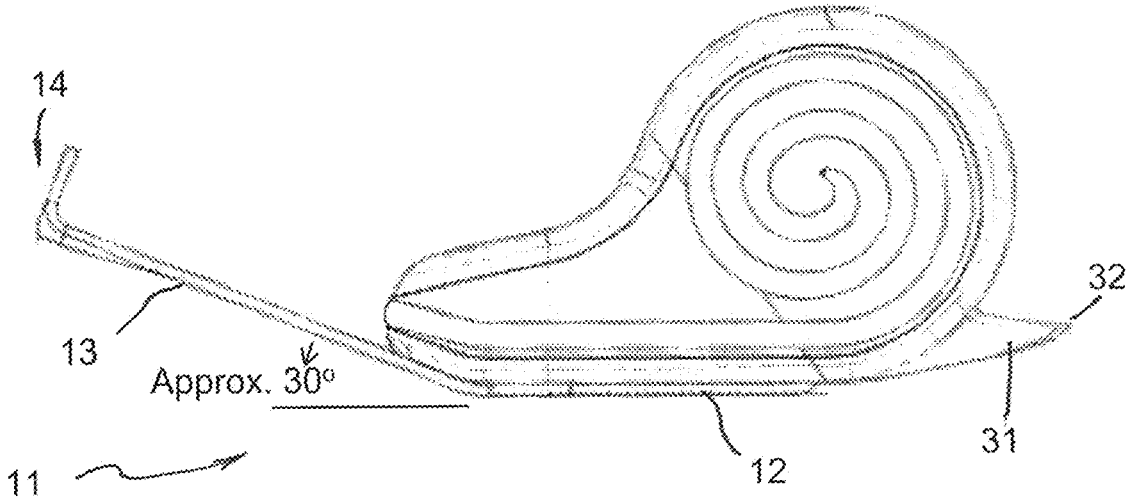
FIG. 4 is a view from the left side.
Figure 5:
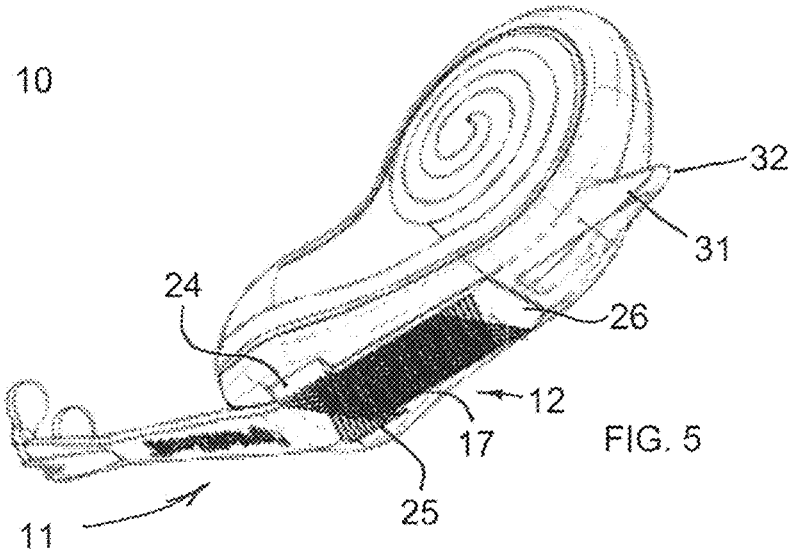
FIG. 5 is a bottom perspective view from the left side and from below.
Figure 6:
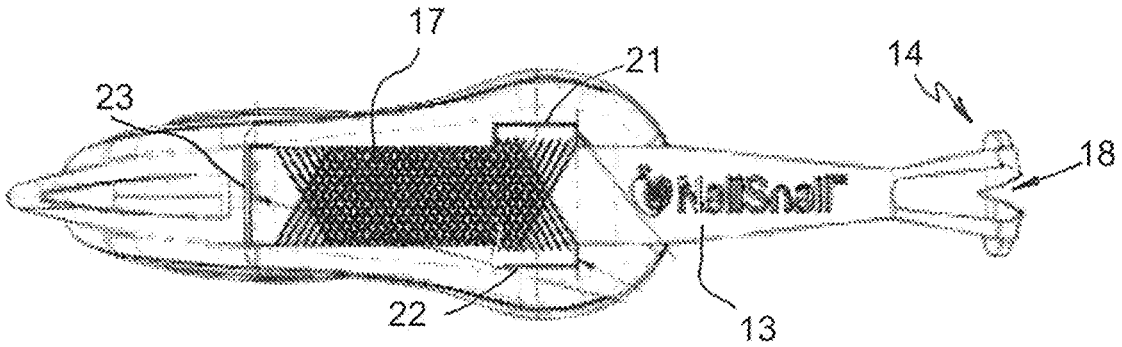
FIG. 6 is a bottom view

Referring to the drawings there is Illustrated a preferred embodiment of the present invention as applied to a novelty snail aspect.

It will it be appreciated that when compared to the prior art that the present invention as Illustrated in the figures is amusing and is likely to comfort an infant when it comes to cutting nails. The "snail" (nail) cutting time can be fun.

The tool 10 may be made from any materials and may be molded as a whole unit, depending upon the novelty aspects chosen, in the present embodiment the tool 10 includes a metal chassis 11 comprising a base 12 a neck section 13 and a head section 14. The head section 14 includes a pair of guards 15 and 16 which are also configured as the eyes or feelers of a snail.

The base 12 has a knurled or roughened surface 17 forming a nail file. The head 14 has a v-blade 18, while the neck 13 is set at an angle of about 30 degrees to the base.

A handle 19 in the form of a snail shell 20 is attached to the base 12 by a hand insertable clip action into three slots 21, 22 and 23 by reason of upturns 24, 25 and 26 in the base 12. The assembly is then ultrasonically welded to give a secure coupling but any process may be employed.

The handle 19 has a complex curved upper surface 27 leading from a top 28 into a flatter front section 29 so that the surface 28 and the section 30 of the shell essentially forms a disc section of the handle while the section 29 essentially provides for a an extra lead in section of the handle so that together they facilitate ease of manipulation. The handle is narrow at the front and wide at the rear along the central plane of the handle and the v-blade while being wider at the front and narrower at the rear across the handle.

Of course depending upon the location and position of the nail to be cut the operator may utilise any part of the tool in order to achieve the desirable cut.

In addition, in the present embodiment the handle includes a snail tail 31 which has a pointed end used as a nail cleaning tool 32. Again the handle is used to manipulate the cleaning tool 32.

While the handle may be a moulded form made as a single piece suitably moulded or it may be made from two moulded parts that fit together, in the preferred embodiment, it is preferable that it also includes a rubber or other similar cover that elastically stretches over the moulded form or may be formed in the moulding process as a softened outer. As a removable cover it facilitates different colours or for different shapes and designs to be incorporated into the snail shell. Thus it could have a "smiley face" or any other decorative effect that would aid in amusing and comforting an infant.

Other aspects of the preferred embodiment are as follows:

Typical materials and colours may include:

Medical grade stainless steel—natural silver colour

Plastic—light turquoise blue colour

Rubber—white colour

Typical dimensions are:

Length: 63.24 mm

Height: 23.56 mm

Width: 15.56 mm

Weight: 7.5 grams

Typical Manufacturing Process includes:

The metal is folded and cut, surface is ground down to form cutting edge.

Metal trimmer is ultrasonically welded to plastic shell.

Plastic injected molded shell frame with rubber over molding.

Acid etched nail file texture.

Logo engraved on underside of metal 'neck'.

Whilst the above has been given by way of illustrative example of the present invention many variations and modifications will be apparent to those skilled in the art without departing from the broad ambit and scope of the invention as set forth in the appended claims.

The invention claimed is:

1. A nail cutting or trimming tool comprising at one end a cutting blade comprising fixed blades and at another end a handle, the tool shaped as a toy creature, comprising at said one end a head of the creature and at said other end, a tail of the creature, to amuse and comfort a child or infant, the toy creature being so made and arranged that it aids in the functional operation of cutting nails.

2. The nail cutting or trimming tool according to claim 1, wherein the one end comprising the cutting blade is configured as the head that is shaped as a snail head to amuse and comfort and the said other end comprising the handle that is shaped as a snail body to amuse and comfort, the configuration dimensions and relative disposition of the handle and the cutting blade being so made and arranged that the handle and cutting blade aid in the functional operation of cutting nails.

3. The nail cutting or trimming tool according to claim 1, wherein the one end comprising the cutting blade is configured as the head, the head configured as a snail head with eyes, and wherein the handle is configured as a snail shell made separately and connected to the head.

4. The nail cutting or trimming tool according to claim 1, wherein the tool comprises a chassis the handle comprising the handle mounted to the chassis, the chassis having a longitudinal axis with a base and a neck inward of the head and terminating at the head, the head having said fixed blades, there being a juncture between the base and the neck such that neck extends from and is inclined to the base, the handle being at an end opposite to the head, the tool having an imaginary central longitudinal plane extending upwardly from the base and the handle having a narrow aspect substantially across the said imaginary central longitudinal plane of the tool and a wide aspect substantially along the said imaginary central longitudinal plane of the tool, the handle tapering toward the neck in the region of the juncture between the base and the neck.

5. The nail cutting or trimming tool according to claim 1, having no moving parts and wherein the tool has a nail file and an under nail cleaning projection adjacent the handle.

6. The nail cutting or trimming tool according to claim 1, being a three in one nail care tool further having a nail file and an under nail cleaner adjacent the handle.

7. The nail cutting or trimming tool according to claim 1, wherein the said one end comprising the cutting blade is spaced from the other end having the handle by a neck section, the fixed cutting blades protruding from the neck section, the configuration dimensions and relative disposition of the handle and the cutting blade being so made and arranged that the handle and cutting blade aid in the functional operation of cutting nails by manual manipulation of the neck section.

8. The nail cutting or trimming tool according to claim 1, wherein the one end comprising the cutting blade is configured as the head, the head configured as a snail head with a safety guard in the form of projecting snail eyes and the handle is configured as a snail shell.

9. The nail cutting or trimming tool according to claim 1, wherein the one end comprising the cutting blade is spaced from the other end comprising the handle by a neck section, the configuration dimensions and relative disposition of the handle and the cutting blade being so made and arranged that the handle and cutting blade aid in the functional operation of cutting nails and wherein the one end comprising the cutting blade is configured as the head, the head configured as a snail head with a safety guard in the form of projecting snail eyes and the handle is configured as a snail shell.

10. The nail cutting or trimming tool according to claim 1, where the fixed blades are blades in a v-configuration.

11. The nail cutting or trimming tool according to claim 1, wherein the handle is configured to aid manipulation of the tool and having a front projection extending toward the one end comprising the cutting blade such that the front projection aids manipulation of the tool by digits of a user's hand.

12. The nail cutting or trimming tool according to claim 1, wherein the handle is configured as a body.

13. The nail cutting or trimming tool according to claim 1, wherein the handle includes a narrow part proximal the fixed blades and a relatively wide part remote from the fixed blades, the tool having a chassis, the handle being mounted to the chassis, the chassis having a longitudinal axis with a base and a neck terminating at the head, the head having the fixed blades, there being a juncture between the base and the neck such that neck extends from and is inclined to the base, the handle at an end opposite to the head, the tool having an imaginary central longitudinal plane extending upwardly from the base and the handle having a narrow aspect substantially across the said imaginary central longitudinal plane of the tool and a wide aspect substantially along the said imaginary central longitudinal plane of the tool, the handle tapering toward the neck in the region of the juncture between the base and the neck.

14. The nail cutting or trimming tool according to claim 1, wherein the handle includes a narrow part proximal the blades and a relatively wide part remote from the blades, the handle being mounted to a chassis, the chassis having a longitudinal axis with a base and a neck terminating at the head, there being a juncture between the base and the neck such that neck extends from and is inclined to the base, the handle at an end opposite to the head, the tool having an imaginary central longitudinal plane extending upwardly from the base and the handle having a narrow aspect substantially across the said imaginary central longitudinal plane of the tool and a wide aspect substantially along the said imaginary central longitudinal plane of the tool, the handle tapering toward the neck in the region of the juncture between the base and the neck the fixed blades having a safety guard and being configured as a trimming blade with a safety guard, and there further being a nail file and an under nail cleaner.

15. The nail cutting or trimming tool according to claim 1, wherein the handle includes a narrow part proximal the fixed blades and a relatively wide part remote from the fixed blades, a chassis, the handle being mounted to the chassis, the chassis having a longitudinal axis with a base and a neck terminating at the head which includes the fixed blades, there being a juncture between the base and the neck such that neck extends from and is inclined to the base, the tool having a central longitudinal plane extending upwardly from the base of the chassis, the handle, at an end thereof opposite to the head having a narrow aspect substantially across the central longitudinal plane of the tool and a wide aspect substantially along the central longitudinal plane of the tool, the handle tapering in the region of the juncture between the base and the neck, the tool having a nail file on the chassis and an under nail cleaning projection adjacent the handle.

16. The nail cutting or trimming tool according to claim 1, wherein the fixed blades comprise a trimming blade configured as the head, the head comprising a "head" of a snail and is a v-shaped metal blade with folded up "eyes" that act as a safety guard, and being the width of a nail being trimmed and positioned to easily follow the natural curve of a nail bed.

17. The nail cutting or trimming tool according to claim 1, wherein the cutting blade comprises a trimming blade configured as the head, the head being configured as a "head" of a snail and comprising a v-shaped metal blade with folded up "eyes" that act as a safety guard, and being the width of a nail being trimmed and positioned to easily follow the natural curve of a nail bed, and further wherein the handle is configured as a "shell" of the snail, there being a "neck" extending from the "shell", the "shell" being rounded and has a flatter part near the neck and is taller remote from the neck.

18. The nail cutting or trimming tool according to claim 1, wherein the handle has a cover of material to improve grip.

19. The nail cutting or trimming tool according to claim 1, wherein there is provided an underside or base and a nail file is on the underside or base and may be used to assist in trimming rough or sharp nail edges.

20. The nail cutting or trimming tool according to claim 2, wherein the one end comprising the cutting blade that is configured as the head is configured as a snail head with eyes, and wherein the handle is configured as a snail shell.

21. The nail cutting or trimming tool according to claim 1, the handle comprising a relatively large portion of said tool, the cutting blade projecting from the relatively large portion of said tool.

* * * * *